US007513445B2

(12) United States Patent
Ricco et al.

(10) Patent No.: US 7,513,445 B2
(45) Date of Patent: Apr. 7, 2009

(54) METERING SOLENOID VALVE FOR A FUEL INJECTOR

(75) Inventors: Mario Ricco, Casamassima (IT); Raffaele Ricco, Valenzano (IT); Sergio Stucchi, Valenzano (IT); Onofrio De Michele, Valenzano (IT); Chiara Altamura, Valenzano (IT); Antonio Gravina, Valenzano (IT); Carlo Mazzarella, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 143 days.

(21) Appl. No.: 11/668,637

(22) Filed: Jan. 30, 2007

(65) Prior Publication Data

US 2008/0092855 A1 Apr. 24, 2008

(30) Foreign Application Priority Data

Oct. 24, 2006 (EP) ..... 06425731

(51) Int. Cl.
*F02M 51/00* (2006.01)

(52) U.S. Cl. ..... 239/585.3; 251/129.16; 251/129.18; 251/129.21

(58) Field of Classification Search ..... 251/129.16, 251/129.18, 129.21; 239/585.3, 585.1
See application file for complete search history.

(56) References Cited

U.S. PATENT DOCUMENTS 5,560,549 A * 10/1996 Ricco et al. ..... 239/585.1
6,131,829 A * 10/2000 Ricco ..... 239/585.1
6,161,813 A * 12/2000 Baumgartner et al. .. 251/129.18
6,305,355 B1 * 10/2001 Hoffmann et al. ..... 251/129.16
6,688,579 B2 * 2/2004 Grytz ..... 251/129.16
6,811,138 B2 * 11/2004 Kuehne et al. ..... 251/129.19
6,877,680 B2 * 4/2005 Bauer et al. ..... 239/585.1
2004/0026644 A1 * 2/2004 Rapp ..... 251/129.16

FOREIGN PATENT DOCUMENTS

| | | | |
|---|---|---|---|
| DE | 10133218 | A1 | 1/2003 |
| EP | 0916843 | A1 | 5/1999 |
| EP | 1577539 | A | 9/2005 |
| EP | 1707798 | A | 10/2006 |

* cited by examiner

*Primary Examiner*—John Bastianelli
(74) *Attorney, Agent, or Firm*—Seed IP Law Group PLLC

(57) ABSTRACT

The metering servo valve comprises a valve body, an open/close element, and an electromagnet, and is housed in a shell of the injector. The electromagnet actuates a mobile armature for a travel defined by an arrest element, carried by the electromagnet, which is housed in a casing, fixed in the shell by means of a threaded ring nut. Said ring nut is screwed with a pre-set tightening torque on a thread of the shell. The casing has a resting surface designed to engage a shoulder of the shell. The surface is carried by an area of the casing designed to undergo deformation as a function of the tightening torque of the ring nut so as to enable fine adjustment of the travel of the armature.

6 Claims, 1 Drawing Sheet

METERING SOLENOID VALVE FOR A FUEL INJECTOR

BACKGROUND OF THE INVENTION

1. Field of the Invention

The present invention relates to a metering servo valve for a fuel injector of an internal-combustion engine.

2. Description of the Related Art

As is known, the servo valve of an injector in general comprises a control chamber of the usual control rod of the injector nozzle. The control chamber is provided with an inlet hole in communication with a pipe for the pressurized fuel and a calibrated hole for outlet or discharge of the fuel, which is normally closed by an open/close element. Normally, the valve body of the servo valve is fixed on a shell of the injector, whilst the open/close element is controlled by the armature of an electromagnet.

The travel or lift of the armature determines the readiness of the response of the servo valve both for opening and for closing, as well as the section of passage of the fuel through the discharge hole, so that it is necessary to regulate accurately the travel of the armature and/or of the open/close element. Servo valves are known with the open/close element separate from the armature, the travel of which is defined on the one hand by arrest against the open/close element in a position of closing of the discharge hole and on the other by arrest of the travel of the armature in the direction of the electromagnet. Adjustment of the travel of the armature is made using at least one rigid shim, which defines the gap of the armature. The shim can be chosen from among classes of calibrated and modular shims. For technological reasons and for economic constraints of feasibility, said shims can vary from one another by an amount of not less than the machining tolerance, for example, 5 μm. The operation of adjustment of the travel of the armature by discrete amounts with a tolerance of 5 μm is, however, relatively rough so that it is often impossible to obtain a flow rate of the injector within the very narrow limits required by modern internal-combustion engines.

From the document EP-A-0 916 843, a servo valve is also known, in which the armature is guided by a sleeve, which carries the arrest element of the armature in the direction of the electromagnet. The sleeve is moreover provided with a flange, which is fixed on the shell, with the interposition of an elastically deformable shim. The electromagnet is housed in a casing, which is fixed on the shell of the injector by means of a threaded ring nut and is provided with a portion acting on the aforesaid flange. The shim is deformed according to the tightening torque of the ring nut so that, by varying said torque, a fine adjustment of the travel of the armature is obtained. However, the presence of said shim and the corresponding selection render the servo valve relatively complicated and costly to manufacture.

In addition, in the known servo valve described above, the open/close element is subjected on one side to the axial thrust exerted by the pressure of the fuel in the control chamber, and on the other to the action of axial thrust of a spring, which is pre-loaded so as to overcome the thrust of the pressure when the electromagnet is not excited. The spring has hence characteristics and overall dimensions such as to be able to exert a considerable axial thrust, for example, in the region of 70 N for a fuel pressure of 1800 bar.

In order to reduce pre-loading of the spring for closing the open/close element, a servo valve has recently been proposed, in which the pressurized fuel no longer exerts an axial action, but acts in a radial direction on the support of the open/close element so that the action of the pressure of the fuel on the open/close element is substantially balanced. The action of the spring and that of the electromagnet can hence be reduced. In addition, the travel of the armature can stop directly against the core of the electromagnet, given that the risk of sticking of the armature is negligible, so that the residual gap with respect to the core itself can be eliminated.

BRIEF SUMMARY OF THE INVENTION

The aim of the invention is to provide an adjustable metering servo valve that will be highly reliable and present limited cost, eliminating the drawbacks of servo valves for metering of fuel according to the known art.

According to the invention, the above aim is achieved by a metering servo valve as defined in claim 1.

BRIEF DESCRIPTION OF THE SEVERAL VIEWS OF THE DRAWINGS

For a better understanding of the invention, a preferred embodiment is described herein, purely by way of example, with the aid of the annexed plate of drawings, wherein.

DETAILED DESCRIPTION OF THE INVENTION

Figure 1:
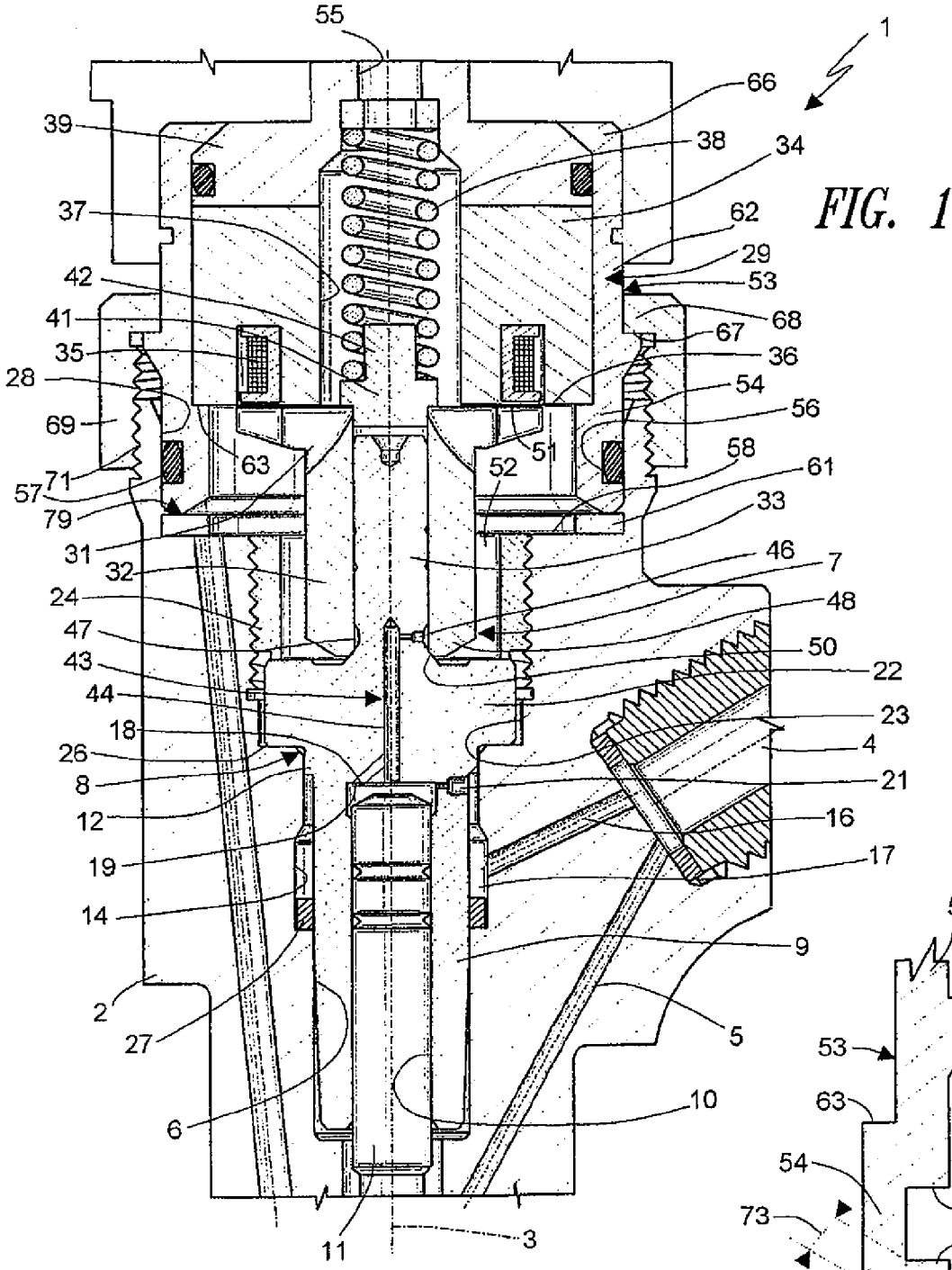
FIG. 1 is a partial cross section of a fuel injector provided with an adjustable metering servo valve according to the invention.

With reference to FIG. 1, designated as a whole by 1 is a fuel injector (partially illustrated) for an internal-combustion engine, in particular a diesel engine. The injector 1 comprises a hollow body or shell 2, which extends along a longitudinal axis 3 and has a side inlet 4 designed to be connected to a pipe for intake of the fuel at high pressure, for example, at a pressure in the region of 1800 bar. The shell 2 terminates with a nozzle (not illustrated), which communicates with the inlet 4 through a pipe 5 and is designed to inject the fuel into a corresponding engine cylinder.

The shell 2 has an axial cavity 6, housed in which is a metering servo valve 7 comprising a valve body 8, having a smaller portion 9 provided with an axial cavity 10. A control rod 11 of the injector 1 is able to slide, in a fluid-tight way, within the cavity 10, and is designed to control in a known way an open/close needle (not illustrated) for closing and opening the fuel-injection nozzle. The portion 9 of the body 8 presents a centering annular projection 12 coupled to a corresponding portion of the internal surface of the cavity 6. This internal surface forms a depression 14, giving out into which another pipe 16 in communication with the inlet 4, so that the depression 14 forms an annular chamber 17 for distribution of the fuel. The space comprised between one end surface 18 of the axial cavity 10 and the end of the rod 11 forms a chamber 19 for control or metering of the servo valve 7, which is in communication with the annular chamber 17 through a calibrated inlet hole 21.

The body 8 moreover has an intermediate portion of larger diameter, which forms a flange 22 for fixing into a corresponding portion 23 of the cavity 6. For said purpose, an externally threaded ring nut 24 engages an internal thread of the portion 23, and is screwed so as to tighten the flange 22 axially in a fluid-tight way against a shoulder 26 formed by the portion 23. Tightness of the annular chamber 17 with the cavity 6 is instead obtained by means of an annular gasket 27.

The shell 2 of the injector 1 is provided with another cavity 28, also coaxial with the axis 3, fixed in which is fixed an electromagnet 29 designed to control a notched-disk armature 31. The armature 31 is made of a single piece with a sleeve 32 extending in a direction opposite to the electromagnet 29 and engaging with a stem 33, which is in turn made of a single piece with the valve body 8, as will be seen more clearly hereinafter. The electromagnet 29 is formed by a magnetic core 34, having a polar surface 36, which is plane and perpendicular to the axis 3. The magnetic core 34 has an annular cavity, housed in which is an electric coil 35, and is provided with an axial cavity 37, housed in which is a helical compression spring 38. This spring 38 is pre-loaded so as to exert an action of thrust on the armature 31 in a direction opposite to the attraction exerted by the electromagnet 29. In particular, the spring 38 has one end resting against a disk 39 for supporting the core 34, and another end acting on the armature 31 through a washer 41, which comprises a block 42 for guiding the end of the spring 38.

The stem 33 of the valve body 8 extends along the axis 3, on the opposite side of the flange 22 with respect to the portion 9 of the valve body 8. The control chamber 19 of the servo valve 7 has a passage for outlet or discharge of the fuel, designated as a whole by 43 and made entirely in the valve body 8. The outlet passage 43 comprises a first blind stretch 44, made along the axis 3 in part in the flange 22 and in part in the stem 33, and a second radial stretch 46 made in the stem 33. The radial stretch 46 is set in an axial position adjacent to the plane surface of the flange 22. It has a calibrated diameter and constitutes the calibrated outlet hole of the control chamber 19, which sets the stretch 44 in communication with an annular chamber 47, obtained by means of a groove in the outer surface of the stem 33.

The sleeve 32 has an internal cylindrical surface, coupled to the side surface of the stem 33 substantially in a fluid-tight way, i.e., by means of coupling with a calibrated diametric play, for example less than 4 μm, or else by interposition of seal elements. The sleeve 32 comprises an end 48 shaped like a truncated cone, which constitutes the open/close element of the servo valve 7.

In particular, the sleeve 32 is designed to slide axially along the stem 33 between an advanced end-of-travel position and a retracted end-of-travel position. The advanced end-of-travel position is such as to close, by means of the open/close element 48, the radial stretch 46 of the discharge passage 43 and is defined by the open/close element 48 bearing upon a portion shaped like a truncated cone 50 for radiusing between the stem 8 and the flange 22. The retracted end-of-travel position is such as to open the radial stretch 46 of the passage 43 and is defined by arrest of the armature 31 against the polar surface 36 of the core 34, with the interposition of a non-magnetic gap lamina 51.

In the advanced end-of-travel position, the fuel exerts a zero resultant of axial thrust on the sleeve 32, since the pressure in the annular chamber 47 acts radially on the sleeve 32, whilst, in the retracted end-of-travel position, the fuel flows from the radial stretch 46 to a discharge or recirculation channel (not illustrated), through an annular passage 52 between the ring nut 24 and the sleeve 32, and through the notches of the armature 31, the cavity 28 of the core 34, and an axial conduit made in the supporting disk 39.

When the electromagnet 29 is energized, the armature 31 is displaced in the direction of the core 34, so that the open/close element 48 opens the passage 43 of the control chamber 19, thus opening the servo valve 7. In this way, there is brought about an axial translation of the rod 11 so as to control opening of the injection nozzle. When the electromagnet 29 is de-energized, the spring 38 brings the armature 31 back to rest with the open/close element 48 against the portion shaped like a truncated cone 50 of the flange 22, as in FIG. 1, so that the open/close element 48 closes again the radial stretch 46 of the discharge passage 43, thus bringing about closing of the servo valve 7.

Figure 2:
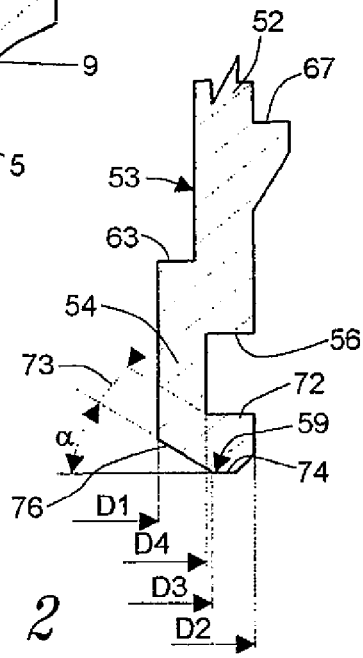
FIG. 2 is a detail of FIG. 1, in an enlarged scale.

The electromagnet 29 is fixed on the shell 2 by means of a casing 53 having a substantially cylindrical shape made of non-magnetic metal material, for example brass or steel of the non-magnetic series (AISI300). In particular, the casing 53 has a lower portion 54 (see also FIG. 2) having an internal diameter D1 and an external diameter D2. The portion 54 is designed to be inserted in the cavity 28 and has an external groove 56, inserted in which is an elastic o-ring 57. The cavity 28 forms, with the portion 23 of the cavity 6, another shoulder 58 designed to be engaged by a resting surface 59 of the casing 53, with the interposition of a rigid shim 61.

The casing 53 presents moreover a second cylindrical portion 62, which has a thickness smaller than that the lower portion 54, and forms with this an internal annular shoulder 63. The cylindrical portion 62 is designed to house the core 34 of the electromagnet 29 without any significant radial play. The casing 53 finally has a top rim 66, which is bent so as to keep the resting disk 39 axially gripped to the core 34 and to keep the latter resting with its polar surface 36 against the shoulder 63 of the casing 53, without axial play. Consequently, the electromagnet 29 is rigidly connected to the casing 53 between the shoulder 63 and, via the disk 39, to the bent rim 66 so as to form a single block.

The cylindrical portion 62 of the casing 53 presents moreover an external annular projection 67, engaged on which is an annular rim 68 of an internally threaded ring nut 69. This ring nut 69 is screwed on a thread 71 of the outer wall of the shell 2 so as to bring the surface 59 of the portion 54 against the shoulder 58 of the cavity 28 of the shell 2 itself.

In order to perform a fine adjustment of the travel of the armature 31, and hence also of the open/close element 48, i.e., an adjustment comprised within 5 μm, which is the difference between the modular classes of shims 61, the resting surface 59 is carried by an area 72 of the casing 53, designed to undergo elastic deformation as a function of the tightening torque of the ring nut 69. In particular, the area 72 is comprised in the cylindrical portion 54 of the casing 53 and is set between the annular projection 67 and the resting surface 59. The area 72 has a cross section 73 of a reduced thickness formed by the groove 56, to enable elastic deformation by bending of the area 72.

In turn, the resting surface 59 comprises a plane external portion 74, and an internal portion shaped like a truncated cone, forming a front chamfer 76 made on the internal surface of the portion 54. The chamfer 76 on the one hand reduces further the thickness of the cross section 73 and on the other guarantees an extensive resting area of the casing 53 against the shim 61, even following upon deformation by bending of the area 72.

Advantageously, the external portion 74 of the surface 59 is such as to have an internal diameter D3 greater than the internal diameter D4 of the groove 56, so that the cross section 73 is in part set in cantilever fashion with respect to the groove 56 itself. Preferably, the surface shaped like a truncated cone of the chamfer 76 has an inclination angle $\alpha$ comprised between 15° and 30° with respect to a plane perpendicular to the axis 3. In addition, the chamfer 76 can extend in such a way that its width ½(D3-D1) is comprised between 25% and 75% of the thickness ½(D2-D1) of the portion 54 of the casing 53.

Adjustment of the travel of the open/close element 48 of the servo valve 7, i.e., of the lift of the armature 31, is performed by choosing first a shim 61 of a class such as to enable, with a pre-set tightening torque of the ring nut 69, a lift of the armature 31 approximating the desired one by excess within 5 μm. Next, a fine adjustment is performed by increasing appropriately the tightening torque of the ring nut 69 so as to vary the elastic deformation of the area 72 of the casing 53.

The variation of the travel of the armature 31 is substantially proportional to the tightening torque of the ring nut 69. It is possible to vary the coefficient of proportionality by varying the stiffness of the section 73 of the portion 72 of the casing 53. This stiffness can be modified by varying slightly the internal diameter D3 of the plane portion 74 of the resting surface 59 of the casing 53.

The adjustment is performed by controlling the angle of tightening of the ring nut (in particular of the torque wrench normally used for tightening the ring nut), or an operating parameter, for example the flow rate of discharge of the servo valve 7, or else the speed of opening of the servo valve 7 and hence the flow rate of the injector 1. In any case, after adjustment of the lift of the armature 31, in order to prevent, with use over time, the ring nut 69 from accidentally unscrewing, for safety reasons it is possible to block the ring nut 69 on the shell 2, for example by means of an electrical-welding spot.

From the above description, the advantages of the adjustable metering servo valve 7 according to the invention with respect to the known art are evident. First of all, the need for a separate deformable shim is eliminated, thus producing a reduction in the costs of manufacture of the injector and of warehousing of parts. In addition, the number of the plane surfaces resting on one another, which require costly machining operations for precision grinding, is reduced. Finally, the casing 53 of the electromagnet 29 according to the invention can be applied also on already existing servo valves.

It is understood that various modifications and improvements can be made to the metering servo valve described herein, without departing from the scope of the claims. For example, the reduced cross section 73 can be obtained with a dedicated groove, independent of the one provided for the gasket 57. In addition, the portion 72 can have an external diameter greater than the external diameter D2 of the portion 54 of the casing 53 itself.

In turn, the discharge passage 43 of the valve body 8 can be provided with a number of radial stretches 46 preferably set at equal angular distance apart from one another. The rigid shim 61 and/or the gap lamina 51 can also be eliminated. In turn, the casing 53 can be constituted by a suitable plastic material. The resting surface 59 can be curved or have a radiusing between the portion 74 and the chamfer 76. Finally, the invention can be applied also to a servo valve having the open/close element separate from the armature of the electromagnet.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A metering servo valve for a fuel injector of an internal-combustion engine, comprising:

a shell having a cavity forming a shoulder in the shell;

a valve body housed in the cavity of the shell;

an open/close element;

an armature being displaceable between a first arrest element and a second arrest element, axially spaced from the first arrest element, the second arrest element being fixed in the valve body, the first arrest element being displaceable to adjust the displacement of the armature;

an electromagnet positioned to affect displacement of the armature;

a casing rigidly housing the electromagnet and having an annular projection and a substantially cylindrical portion including an inner surface toward the cavity of the shell, an outer surface, opposed to the inner surface, an annular groove formed on the outer surface and configured to house an elastic o-ring, a resting surface, and an elastically deformable region toward the resting surface, the cylindrical portion at least partially extending between the annular projection and the resting surface, the resting surface having at least one planar region substantially perpendicular to an axis of the shell and a tapered region adjacent the resting surface and positioned internally toward the cavity of the shell with respect to the planar region, the elastically deformable region being positioned adjacent the tapered region and including a cross section having a reduced thickness designed to enable elastic deformation by bending of the elastically deformable region, the cross section being formed between the annular groove and the tapered region, the planar region having an inner diameter greater than the inner diameter of the groove, so that the cross section of the tapered region is in part set in cantilever fashion with respect to the groove; and a ring nut engaging the annular projection of the casing and threadedly coupled to the shell with a tightening torque to fixedly couple the casing to the shell and urge the resting surface of the cylindrical portion of the casing against the shoulder of the shell wherein the elastically deformable region of the cylindrical portion of the casing is designed to undergo elastic deformation as a function of the tightening torque.

2. The metering servo valve according to claim 1 wherein the radial extension of the tapered region includes a reduced thickness of approximately 25% to 75% of the thickness of the cylindrical portion.

3. The metering servo valve according to claim 1 wherein the tightening torque is predetermined.

4. The metering servo valve according to claim 1, further comprising:

a shim positioned between the resting surface of the cylindrical portion of the casing, and the shoulder of the shell.

5. A metering servo valve for a fuel injector of an internal-combustion engine, comprising:

a shell having a cavity forming a shoulder in the shell;

a valve body housed in the cavity of the shell;

an open/close element;

an armature;

an electromagnet in electromagnetic communication with the armature, wherein:

the open/close element is controlled by the armature and the electromagnet is rigidly fixed in a casing, the armature being displaceable between a first arrest element and a second arrest element, the second arrest element being fixed in the valve body, the first arrest element being displaceable for adjusting the displacement of the armature, the casing including a substantially cylindrical portion having a resting surface and being fixed on the shell by a ring nut engaging an annular projection of the casing, the ring nut being threaded with a pre-set tightening torque on a thread of the shell so as to urge the resting surface against the shoulder, the cylindrical portion being positioned between the annular projection and the resting surface and including an elastically deformable region designed to undergo elastic deformation as a function of the tightening torque, the resting surface including at least one planar region perpendicular to an axis of the shell and a tapered region having a tapered surface terminating at one end of the planar region, the cylindrical portion including an annular groove made on the outer surface of the cylindrical portion, wherein the tapered region is positioned towards the inside of the casing with respect to the planar region.

6. The servo valve according to claim 5 wherein the planar region has an inner diameter greater than the inner diameter of the groove, so that the cross section is in part set in cantilever fashion with respect to said groove.

* * * * *